US006554571B1

(12) United States Patent
Lee et al.

(10) Patent No.: US 6,554,571 B1
(45) Date of Patent: Apr. 29, 2003

(54) CURVED TURBULATOR CONFIGURATION FOR AIRFOILS AND METHOD AND ELECTRODE FOR MACHINING THE CONFIGURATION

(75) Inventors: Ching-Pang Lee, Cincinnati, OH (US); Bin Wei, Mechanicville, NY (US); Robert Alan Johnson, Simpsonville, SC (US); Hsin-Pang Wang, Rexford, NY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 09/683,189

(22) Filed: Nov. 29, 2001

(51) Int. Cl.[7] ..... F04D 29/38
(52) U.S. Cl. ..... 416/92; 416/96 R; 416/97 R
(58) Field of Search ..... 416/92, 96 R, 416/97 R, 95 R

(56) References Cited

U.S. PATENT DOCUMENTS

| | | | | | |
|---|---|---|---|---|---|
| 4,416,585 | A | * | 11/1983 | Abdei-Messeh | 416/97 R |
| 4,514,144 | A | | 4/1985 | Lee | |
| 4,627,480 | A | | 12/1986 | Lee | |
| 4,775,296 | A | * | 10/1988 | Schwarzmann et al. | 416/97 R |
| 5,232,343 | A | * | 8/1993 | Butts | 416/97 R |
| 5,346,341 | A | * | 9/1994 | Hall et al. | 416/97 R |
| 5,395,212 | A | * | 3/1995 | Anzai et al. | 416/97 R |
| 5,738,493 | A | | 4/1998 | Lee et al. | |
| 5,797,726 | A | | 8/1998 | Lee | |
| 6,068,445 | A | * | 5/2000 | Beeck et al. | 416/96 R |
| 6,089,826 | A | * | 7/2000 | Tomita et al. | 416/96 R |
| 6,110,350 | A | | 8/2000 | Wei et al. | |
| 6,139,715 | A | | 10/2000 | Wei | |
| 6,200,439 | B1 | | 3/2001 | Wei et al. | |
| 6,234,752 | B1 | | 5/2001 | Wei et al. | |
| 6,264,822 | B1 | | 7/2001 | Wei et al. | |
| 6,267,868 | B1 | | 7/2001 | Wei et al. | |
| 6,290,461 | B1 | | 9/2001 | Wei et al. | |
| 6,303,193 | B1 | | 10/2001 | Guida et al. | |

* cited by examiner

*Primary Examiner*—Edward K. Look
*Assistant Examiner*—James M McAleenan
(74) *Attorney, Agent, or Firm*—Penny A. Clarke; Patrick K. Patnode

(57) ABSTRACT

A curved turbulator configuration is in a radial cooling passage of an airfoil, where the radial cooling passage is defined by at least a leading wall and a trailing wall, and the airfoil includes a tip and a root. The curved turbulator configuration includes a number of spaced curved turbulator pairs positioned along a center-line on an inner surface of the leading wall and a number of spaced complementary curved turbulator pairs positioned along a center-line on an inner surface of the trailing wall. An electrode for forming the curved turbulator configuration in the radial cooling passage includes a leading face having a curved turbulator pattern, a trailing face having a complementary curved turbulator pattern, a conductive core, and an insulating coating disposed thereon that is partly removed.

22 Claims, 8 Drawing Sheets

Fig. 13
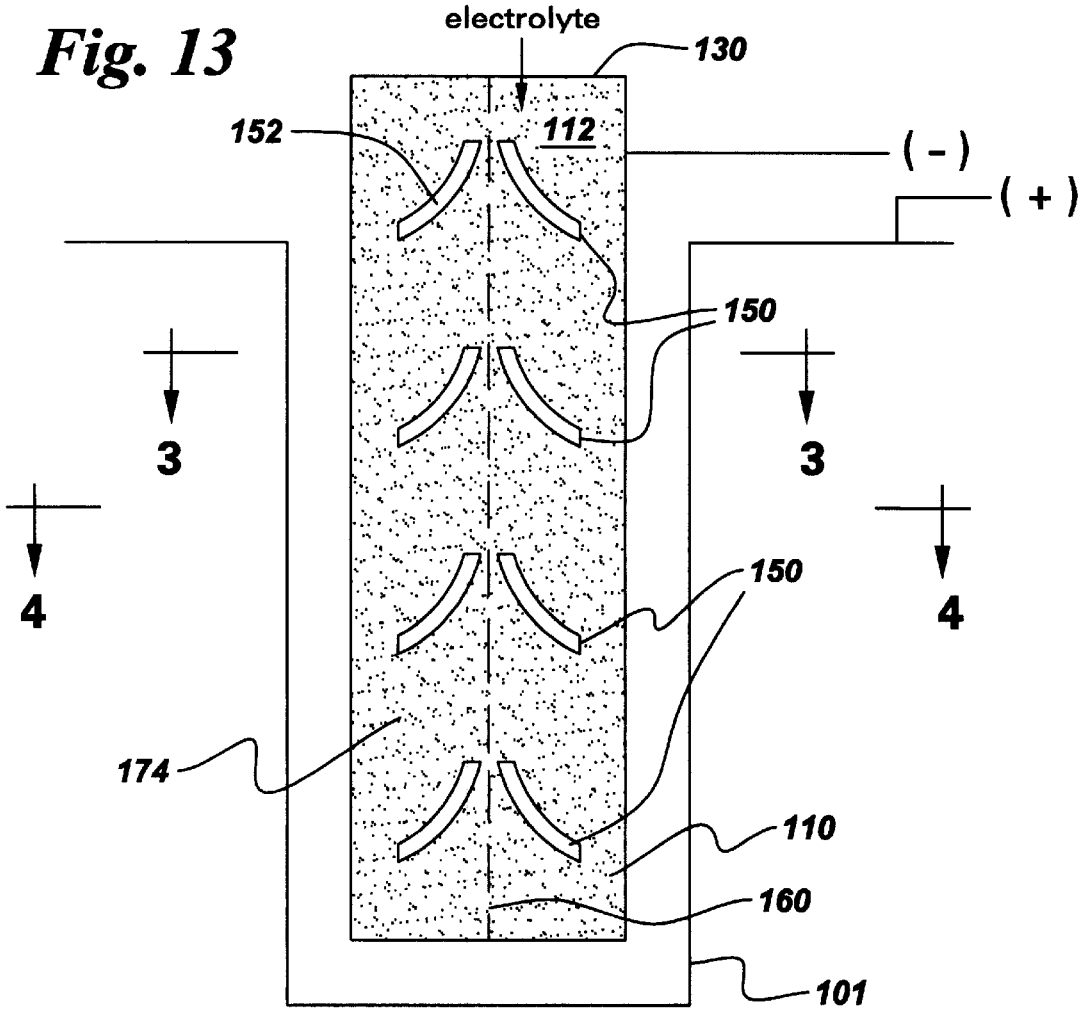
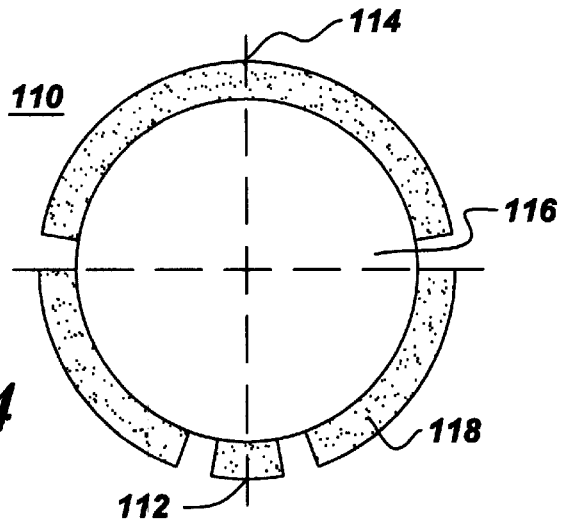
Fig. 14

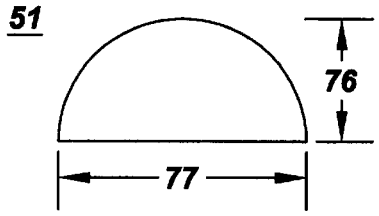
Fig. 19
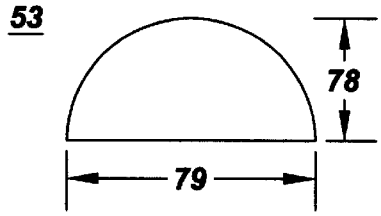
Fig. 20
Fig. 21
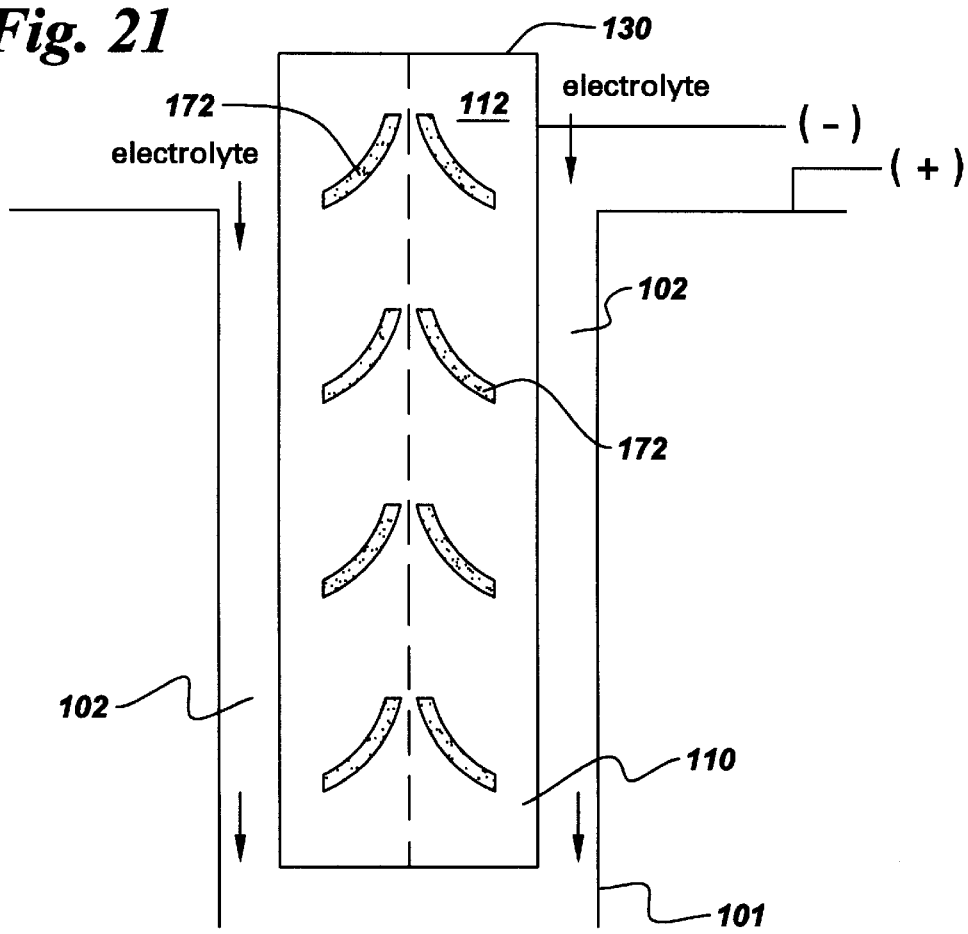

CURVED TURBULATOR CONFIGURATION FOR AIRFOILS AND METHOD AND ELECTRODE FOR MACHINING THE CONFIGURATION

CROSS REFERENCE TO RELATED APPLICATIONS

This application is related to commonly assigned U.S. Pat. No. 6,264,822 B1, Bin Wei et al, entitled "Method for Electrochemical Machining," and U.S. Pat. No. 6,267,868 B1, Bin Wei et al, entitled "Method and Tool for Electrochemical Machining," which are incorporated by reference in their entirety. This application is also related to commonly assigned U.S. Pat. No. 6,200,431 B1, Bin Wei et al, entitled "Tool for Electrochemical Machining," U.S. Pat. No. 6,234,752 B1, Bin Wei and Hsin-Pang Wang, entitled "Method and Tool for Electrochemical Machining," and U.S. Pat. No. 6,303,193 B1, Guida Renato et al, entitled "Process for Fabricating a Tool Used in Electrochemical Machining," which are incorporated by reference in their entirety.

BACKGROUND OF THE INVENTION

The invention relates generally to internal cooling of rotating turbine blades (hereinafter "rotor blades") and, more particularly, to turbulator configurations for inner surfaces of cooling passages within rotor blades.

In gas turbine engines, hot gases from a combustor are used to drive a turbine. The gases are directed across rotor blades, which are radially connected to a rotating turbine rotor disk. Such gases are relatively hot. The capacity of the engine is limited to a large extent by the ability of the rotor blade material to withstand the resulting temperature and stress. In order to decrease blade temperature, thereby improving thermal capability, it is known to supply cooling air to hollow cavities within the blades. Typically one or more cooling passages are formed within a blade with a coolant (such as compressor discharge air) supplied through an opening at the root of the blade and allowed to exit through cooling holes strategically located on the blade surface and/or blade tip. The cooling passages provide convective cooling inside the blade and film-type cooling on the surface of the blade. Many different cavity geometries have been employed to improve heat transfer to the cooling air inside the blade. For example, cooling passages typically have circular, rectangular, square or oblong transverse cross-sectional shapes.

One known rotor blade cooling circuit includes a plurality of unconnected longitudinally-oriented passages (hereinafter "radial cooling passages") extending through an airfoil of the rotor blade. Each radial cooling passage receives cooling air from near the root of the airfoil and channels the air longitudinally toward the tip of the airfoil. Other cooling circuits are serpentine, comprising a plurality of longitudinally-oriented passages which are series-connected to produce serpentine flow. For either cooling circuit, some air exits the blade through film cooling holes near the blade's leading edge and some air exits the blade through trailing edge cooling holes.

It is known that for a rotor blade, the flow of coolant inside the cooling passage includes a secondary flow pattern caused by Coriolis (rotation) forces. More precisely, for a rotor blade, the Coriolis force increases the heat transfer along certain walls of the passage and decrease the heat transfer along other walls of the passage as compared with a stationary airfoil. Briefly, the Coriolis force is proportional to the vector cross product of the velocity vector of the coolant flowing through the cooling passage and the angular velocity vector of the rotor blade. Accordingly, the Coriolis force compresses the coolant against one side of the passage increasing the heat transfer at that side while decreasing the heat transfer at the opposite side. This creates an uneven transverse cross-section blade temperature profile, which creates hot areas that must be compensated for by, for example, increasing the cooling flow. Increasing the cooling flow could be accomplished by bleeding off more engine compressor air, but this would reduce the engine's efficiency by reducing the number of miles flown for each gallon of fuel consumed.

It is further known to provide turbulence promoters or "turbulators" in the cooling passages of rotor blades to generate turbulence near the cooling passage wall. By creating turbulence in the vicinity of the turbulator, heat transfer between the coolant and the cooling passage wall is enhanced.

Currently, radial cooling passages are formed in large turbine blades using shaped-tube electrochemical machining (STEM), in which the blade functions as an anode, while a plurality of drilling tubes function as cathodes in the STEM process. Briefly, the blade is flooded with an electrolyte solution from the drilling tubes, and material is deplated from the blade in the vicinity of the leading edge of the drilling tubes to form the cooling passages. The STEM process is modified to form turbulated ridges in the cooling passages. One common modified STEM method is termed "cyclic dwelling." With this technique, the drilling tube is first fed forward, and then the advance is slowed or stopped in a cyclic manner. The dwelling of the tool that occurs when the feed rate is decreased or stopped creates a local enlargement of the passage diameter, or a bulb. The cyclic dwelling, for which cyclical voltage changes may be required, causes ridges to be formed between axially spaced bulbs. These ridges are the turbulators.

In addition to being inefficient (for example, the dwell time to form a bulb can exceed the time to drill a straight-walled cooling passage), the cyclic dwelling method produces turbulators that extend circumferentially around the cooling passage wall (hereinafter "annular turbulators.") The annular turbulators are deficient in that they do not exploit the secondary flow caused by the Coriolis force.

Accordingly, there is a need in the art for new and improved turbulator configurations for radial cooling passages in rotor blades. New and improved turbulator configurations that cooperate with the secondary flow caused by the Coriolis force would enhance heat transfer from the cooling passage wall to the coolant, thereby facilitating reduced cooling flow (i.e., bleeding off less compressor air), which in turn increases turbine engine efficiency. There is a corresponding need for rotor blades having radial cooling passages that incorporate the improved turbulator configurations. Such rotor blades would advantageously have higher heat transfer coefficients, enhancing turbine engine efficiency. Moreover, there is a corresponding need for a method and tool to efficiently form the improved turbulator configurations.

SUMMARY OF INVENTION

Briefly, in accordance with a turbulator configuration embodiment of the present invention, a curved turbulator configuration is provided in a radial cooling passage of an airfoil, the radial cooling passage defined by at least a leading wall and a trailing wall, the airfoil including a tip and a root. The curved turbulator configuration includes a number of spaced curved turbulator pairs positioned along a center-line on an inner surface of the leading wall, and a number of spaced complementary curved turbulator pairs positioned along a center-line on an inner surface of the trailing wall.

An airfoil embodiment of the invention includes a tip including at least one exit hole. The airfoil further includes a root and a body extending between the tip and the root. The body includes a pressure side and a suction side and a leading wall on the suction side and a trailing wall on the pressure side. The airfoil further includes at least one radial cooling passage extending through the body between the tip and the root. The radial cooling passage is defined by at least an inner surface of the leading wall and an inner surface of the trailing wall. The airfoil further includes the curved turbulator configuration, according to the turbulator configuration embodiment, integrated with the inner surfaces of the leading and trailing walls. The exit hole is connected to the radial cooling passage and is configured to vent coolant from the airfoil after the coolant flows through the radial cooling passage.

A rotor blade embodiment of the invention includes a shank and the airfoil according to the airfoil embodiment. The airfoil is attached to the shank.

An electrochemical machining method embodiment of the invention is provided for forming the curved turbulator configuration on the inner surface of the leading wall of the airfoil and on the inner surface of the trailing wall of the airfoil, the inner surfaces defining a radial cooling passage extending between the tip and the root of the airfoil. The electrochemical machining method includes positioning an electrode in a predrilled hole in the airfoil, the electrode comprising a conductive core and an insulating coating, the electrode having a leading face and a trailing face. The insulating coating provides a curved turbulator pattern on the leading face and a complementary curved turbulator pattern on the trailing face. The method further includes machining at least one pair of curved turbulators on the inner surface of the leading wall using the curved turbulator pattern and at least one pair of complementary curved turbulators on the inner surface of the trailing wall using the complementary curved turbulator pattern. The pairs of curved turbulators and complementary curved turbulators are machined simultaneously by passing an electric current between the electrode and the airfoil while circulating an electrolyte solution through the predrilled hole.

An electrode embodiment of the invention for forming the curved turbulator configuration in the radial cooling passage within the airfoil includes a leading face having a curved turbulator pattern, a trailing face having a complementary curved turbulator pattern, a conductive core, and an insulating coating disposed on the conductive core. The insulating coating is partly removed. The curved turbulator pattern includes a number of pairs of curved exposed portions of the conductive core, and the complementary curved turbulator pattern includes a number of pairs of complementary curved exposed portions of the conductive core.

Another electrode embodiment of the invention for forming the curved turbulator configuration in the radial cooling passage within the airfoil includes the leading face having a curved turbulator pattern, the trailing face having a complementary curved turbulator pattern, the conductive core, and the insulating coating disposed on the conductive core. The insulating coating is partly removed to include a number of pairs of curved portions of the insulating coating on the leading face and a number of pairs of complementary curved portions of the insulating coating on the trailing face. Each of the curved portions and the complementary curved portions is surrounded by an exposed region of the conductive core. For this embodiment, the curved turbulator pattern comprises the pairs of curved portions of the insulating coating, and the complementary curved turbulator pattern comprises the pairs of complementary curved portions of the insulating coating.

BRIEF DESCRIPTION OF DRAWINGS

These and other features, aspects, and advantages of the present invention will become better understood when the following detailed description is read with reference to the accompanying drawings in which like characters represent like parts throughout the drawings, wherein:

FIG. 13 is a schematic representation of another electrode embodiment of the invention, the electrode being positioned in a predrilled hole for electrochemical machining the curved turbulator configuration in the predrilled hole;

FIG. 14 is a cross-section the electrode of FIG. 13 taken along the line 3;

FIG. 19 is a cross-section of one of the curved turbulators of FIG. 17, taken along the line 5;

FIG. 20 is a cross-section of one of the complementary curved turbulators of FIG. 18, taken along the line 6;

FIG. 21 shows a solid electrode embodiment of the electrode of FIG. 8.

DETAILED DESCRIPTION

Figure 1:
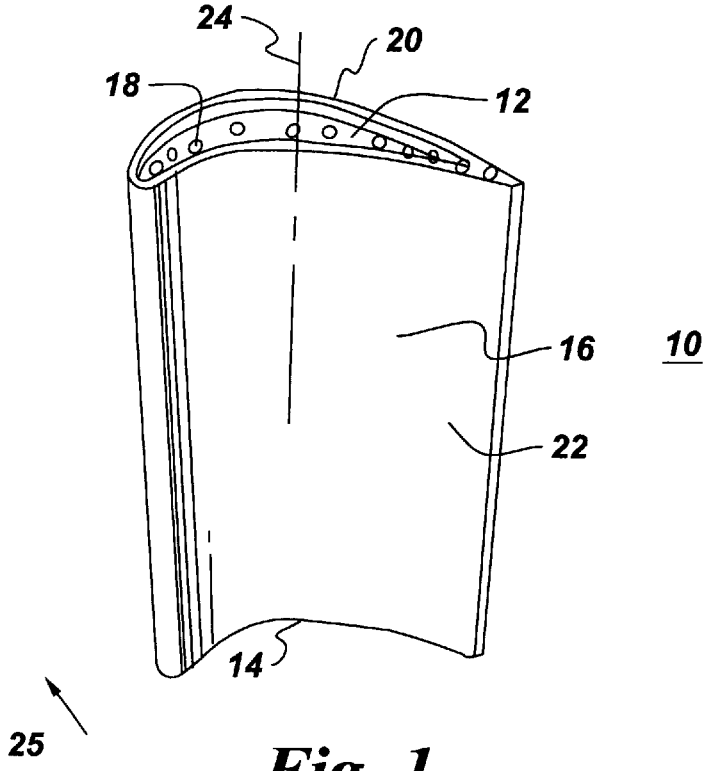
FIG. 1 is a perspective view of an airfoil embodiment of the present invention.

An airfoil 10 embodiment of the present invention is illustrated in FIG. 1. The airfoil includes a tip 12 and a root 14. The tip includes at least one exit hole 18 for coolant, such as air. A body 16 extends between the tip and the root. The body includes a pressure side 22 and a suction side 20. As shown in FIG. 1, the suction side 20 is convex-shaped and the pressure side 22 is concave-shaped. A longitudinal axis 24 extends radially outward between the tip and the root. The airfoil is configured to rotate in a direction such that the pressure side follows the suction side. The direction of rotation for the airfoil is depicted by an arrow 25.

Figure 2:
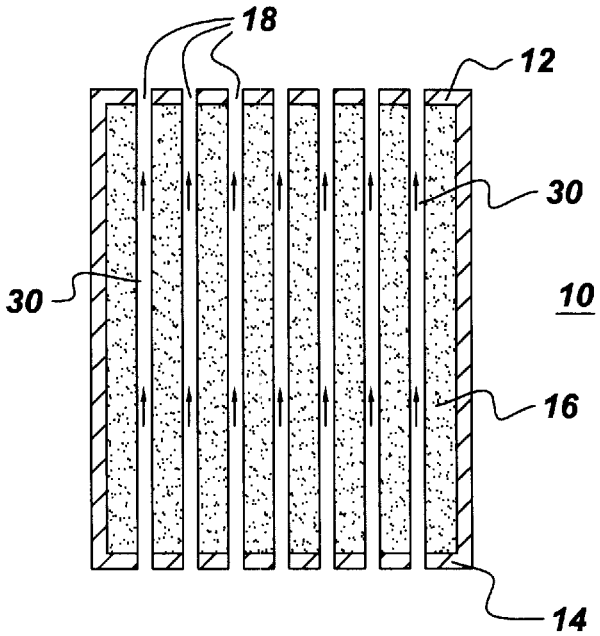
FIG. 2 is a cross-section of the airfoil of FIG. 1.

As seen in FIG. 2, the airfoil 10 includes at least one radial cooling passage 30 that extends through the body 16 between the tip 12 and the root 14. The radial cooling passage directs the flow of cooling air or coolant through the airfoil. As indicated by the arrows in FIG. 2, the radial cooling passage directs air toward the tip of the airfoil ("radially outward"). After passing through the radial cooling passage, the coolant exits the airfoil through the exit hole 18 in the tip.

Figure 3:
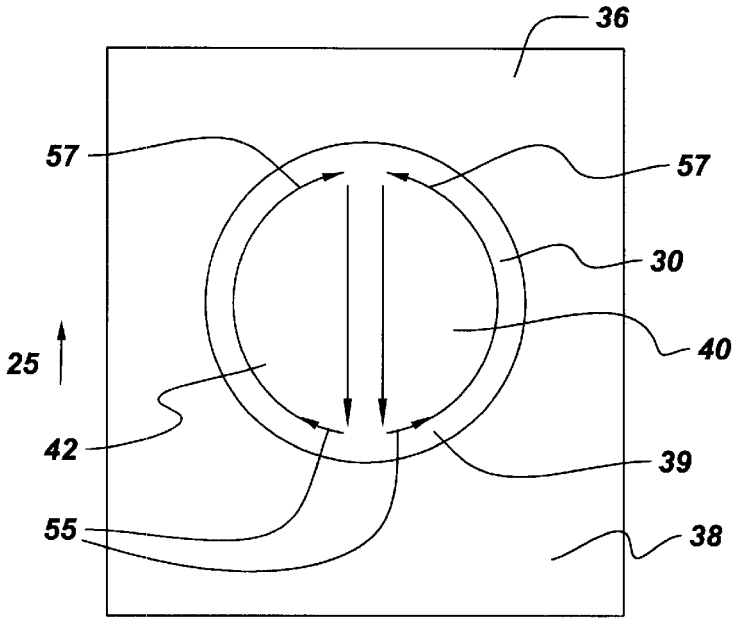
FIG. 3 is a partial cross-section of the airfoil shown in FIG. 2 and depicts a radial cooling passage in the airfoil.

Radial cooling passage 30 is defined by at least a leading wall 36 and a trailing wall 38, as shown in FIG. 3. FIG. 3 shows a cross-section of the radial cooling passage. The leading and trailing walls conform substantially in direction to the suction side 20 and the pressure side 22, respectively, of the body 16 of the airfoil 10. The leading and trailing walls include inner surfaces 37, 39 that at least partially define the radial cooling passage.

As shown in FIG. 2, the flow of coolant through radial cooling passage 30 is in a radially outward direction with respect to longitudinal axis 24 (i.e., toward the tip 12). The airfoil rotates during operation of a turbine engine (not shown) and the rotation interacts with the flow of coolant through the radial cooling passage to produce the Coriolis force on the coolant. The Coriolis force in turn creates secondary flow ("rotation induced secondary flow") in the radial cooling passage. As shown for example in FIG. 3, for the radial cooling passage the rotation induced secondary flow comprises a pair of counter rotating circulations 40, 42, which move the coolant from the leading wall to the trailing wall.

In order to generate turbulence within the radial cooling passage 30, a curved turbulator configuration is integrated with the inner surfaces 37, 39 of the leading and trailing walls 36, 38. The curved turbulator configuration includes a plurality of spaced curved turbulator pairs 50 positioned along a center-line 48 on the inner surface 37 of the leading wall 36, as shown for example in FIG. 4. The curved turbulator configuration further includes a plurality of spaced complementary curved turbulator pairs 52 positioned along a center-line 54 on the inner surface 39 of the trailing wall 38, as shown for example in FIG. 5. Exemplary curved and complementary curved turbulator pairs 50, 52 include raised ridges and grooves, which are discussed below with respect to FIGS. 8, 11 and 12 (raised ridges) and FIGS. 13, 15 and 16 (grooves). The combination of radial core flow through radial passage 30 and secondary flow induced by the Coriolis force produces a curved flow pattern in the boundary layer flow near walls 36, 38. Advantageously, placement of curved turbulator pairs 50, 52 along the curved flow pattern prevents undesirable stagnation of flow near walls 36, 38.

Figure 4:
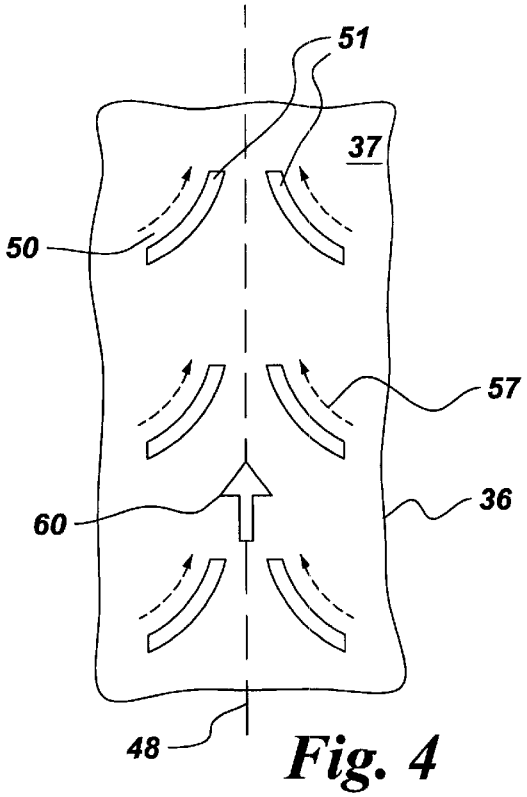
FIG. 4 is a partial cross-sectional view of the radial cooling passage shown in FIG. 3 and shows a curved turbulator configuration embodiment of the present invention on a leading wall of the airfoil of FIGS. 1–3.
Figure 5:
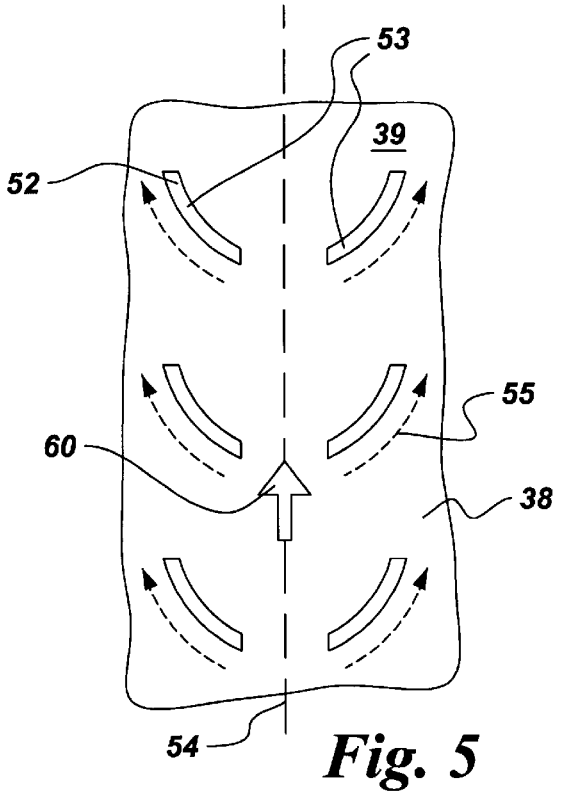
FIG. 5 is a partial cross-sectional view of the radial cooling passage shown in FIG. 3 and shows the curved turbulator configuration on a trailing wall of the airfoil of FIGS. 1–3.

Referring now to FIGS. 3 and 4, in order to enhance the flow of coolant along the inner surfaces 37, 39 ("boundary layer flow"), the turbulator pairs 50 on the inner surface 37 of the leading wall are curved facing away from the center-line 48 and facing the tip 12 according to another embodiment. As shown for example in FIG. 4, this configuration of turbulator pairs directs secondary flow 57 in a manner consistent with circulations 40, 42. In addition, the complementary turbulator pairs 52 on the inner surface 39 of the trailing wall are curved facing toward the center-line 54 and facing the tip, according to this embodiment. As shown for example in FIG. 5, secondary flow 55 along the trailing wall is directed in a manner consistent with the circulations 40, 42. Accordingly, for this curved turbulator configuration, the Coriolis force enhances the coolant motion along the inner surfaces of the leading and trailing walls and consequently the heat transfer between the coolant and the leading and trailing walls.

According to one embodiment, airfoil 10 includes a number of cooling passages 30, as shown for example in FIGS. 1 and 2. According to this embodiment, a number of exit holes 18 are formed in tip 12, as is also shown for example in FIGS. 1 and 2. A curved turbulator configuration is integrated with inner surfaces 37, 39 of leading and trailing walls 36, 38 that define each of the radial cooling passages 30, according to this embodiment.

A curved turbulator configuration embodiment of the invention is described above with respect to airfoil 10. According to a more specific embodiment, each curved turbulator pair 50 includes two curved turbulators 51 separated by a first gap 64, as shown for example in FIG. 17. Similarly, each complementary curved turbulator pair 52 comprises two complementary curved turbulators 53 separated by a second gap 66, as shown for example in FIG. 18. The curved turbulators 51 have a first depth 76 and a first width 77, as shown for example in FIG. 19. Similarly, the complementary curved turbulators 53 have a second depth 78 and a second width 79, as shown for example in FIG. 20. Although the curved turbulators 51, 53 are shown in FIGS. 19 and 20 as having hemispherical cross-sections, the turbulators of the present invention are not limited to such cross-sections and exemplary turbulator cross-sections are semi-oval or rectangular.

Figure 17:
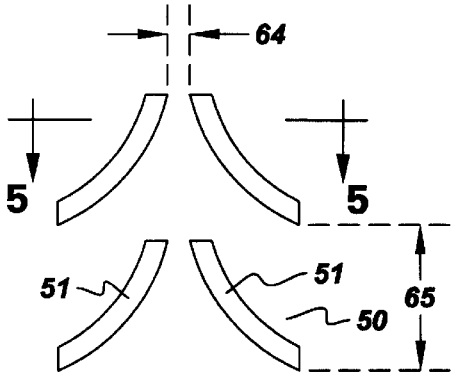
FIG. 17 is an enlarged view of two neighboring curved turbulator pairs of the curved turbulator configuration shown in FIG. 4.
Figure 18:
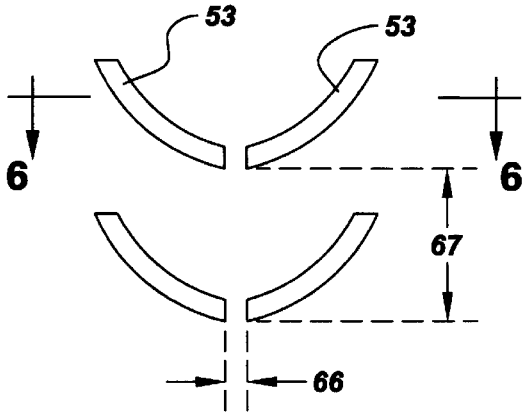
FIG. 18 is an enlarged view of two neighboring complementary curved turbulator pairs of the curved turbulator configuration shown in FIG. 5.

Exemplary heights 76, 78 and widths 77, 79 are in a range of about 0.13 mm to about 2.54 mm. According to this embodiment, exemplary gaps 64, 66 are also in a range of about 0.13 mm to about 2.54 mm. As shown in FIGS. 17 and 18, the curved turbulator pairs 50 are separated by a first pitch distance 65, and the complementary curved turbulator pairs 52 are separated by a second pitch distance 67. For this embodiment, exemplary pitch distances are in a range of about 0.64 mm to about 50.8 mm, and more particularly, in a range of about 0.89 mm to about 38.1 mm.

According to a more particular embodiment, exemplary heights 76, 78 and widths 77, 79 are in a range of about 0.25 mm to about 1.27 mm. According to this embodiment, exemplary gaps 64, 66 are also in a range of about 0.25 mm to about 1.27 mm. Exemplary pitch distances 65, 67 for this embodiment are in a range of about 1.27 mm to about 24.4 mm and, more particularly, in a range of about 1.78 mm to about 19.1 mm.

Figure 6:
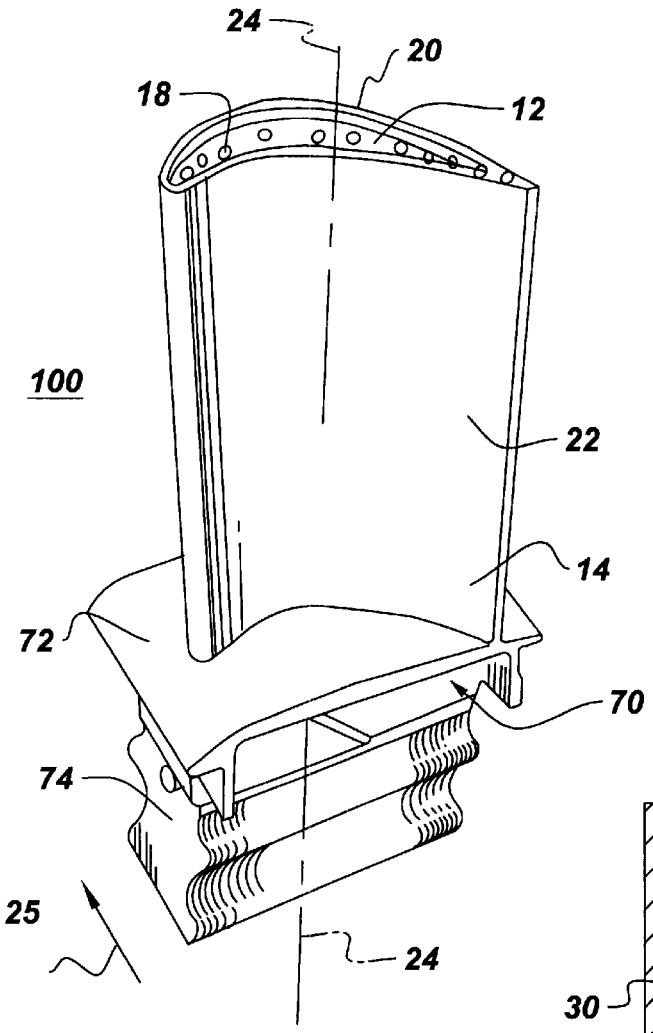
FIG. 6 is a perspective view of a rotor blade embodiment of the present invention.
Figure 7:
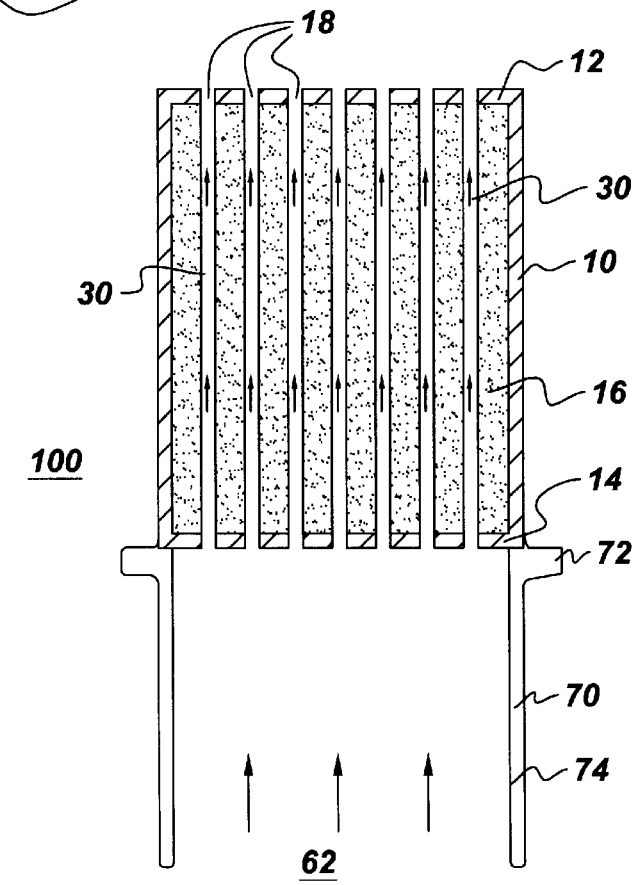
FIG. 7 shows the rotor blade of FIG. 6 in cross-sectional view.

A rotor blade 100 embodiment of the invention is illustrated in perspective view in FIG. 6 and in cross-sectional view in FIG. 7. The rotor blade includes a shank 70 and the airfoil 10. The airfoil is discussed above. The shank includes a blade platform 72, which helps to radially contain the turbine air flow, and a dovetail 74, which attaches to a turbine rotor disk (not shown). The rotor blade 10 rotates in the direction 25 such that the pressure side 22 follows the suction side 20 of the airfoil.

As described with respect to the airfoil embodiment, the airfoil 10 includes at least one radial cooling passage 30. The radial cooling passage is defined by at least inner surface 37 of the leading wall 36 and inner surface 39 of the trailing wall 38 of the airfoil body 16. The radial cooling passage receives coolant from an inlet 62 in the shank 70, as illustrated for example in FIG. 7. After flowing through the radial cooling passage, the coolant exits the airfoil through hole 18 in the tip 12, as shown for example in FIG. 7.

In order to generate turbulence within radial cooling passage 30, the curved turbulator configuration is integrated with the inner surfaces 37, 39 of the leading and trailing walls 36, 38. The curved turbulator configuration is described with respect to the airfoil embodiment and illustrated in FIGS. 4 and 5.

Figure 8:
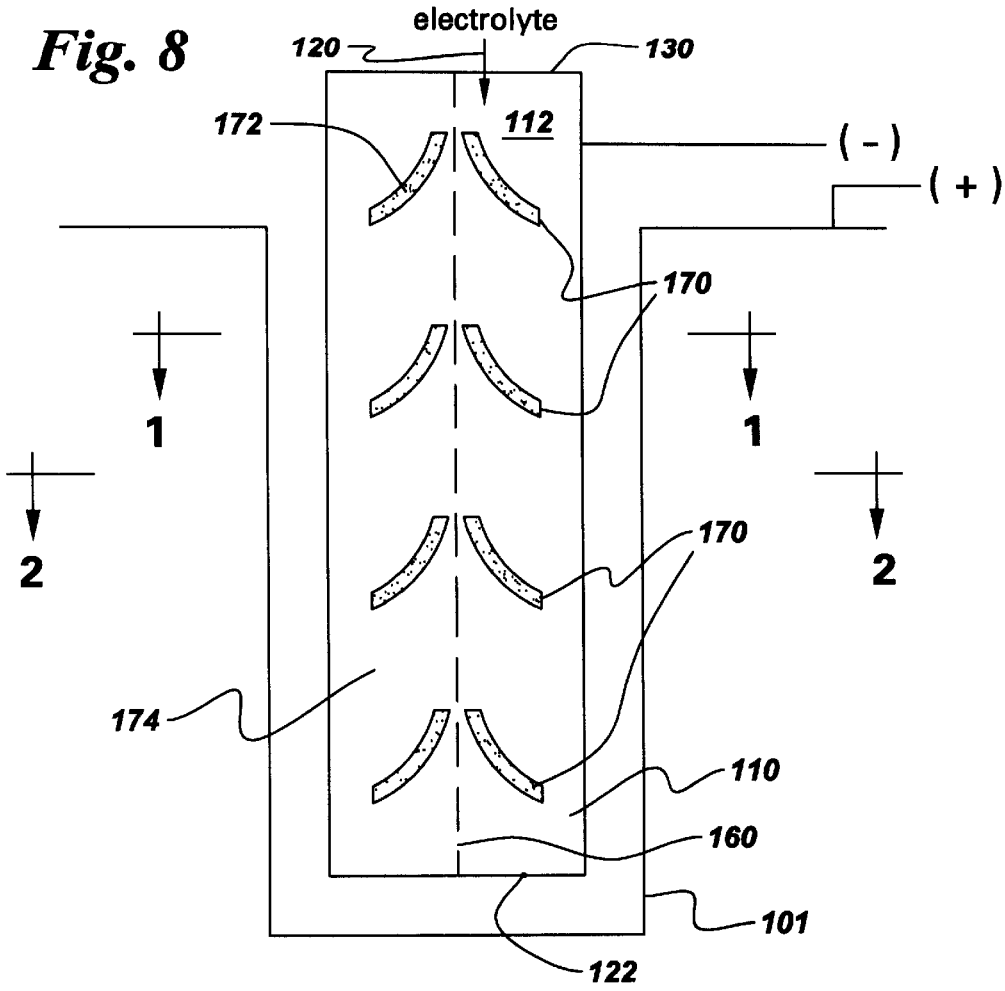
FIG. 8 is a schematic representation of an electrode embodiment of the invention, the electrode being positioned in a predrilled hole for electrochemical machining the curved turbulator configuration in the predrilled hole.
Figure 9:
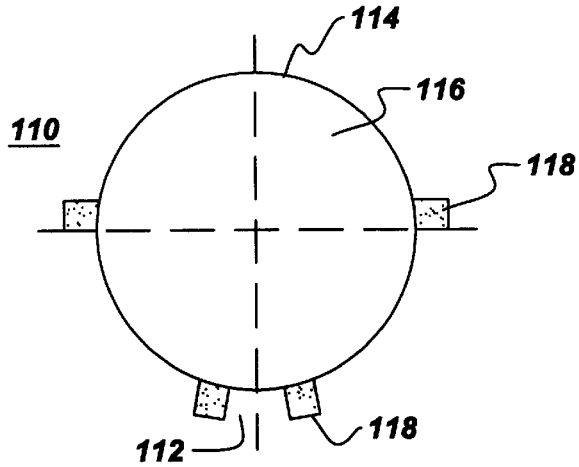
FIG. 9 is a cross-section of the electrode of FIG. 8 taken along the line 1.
Figure 10:
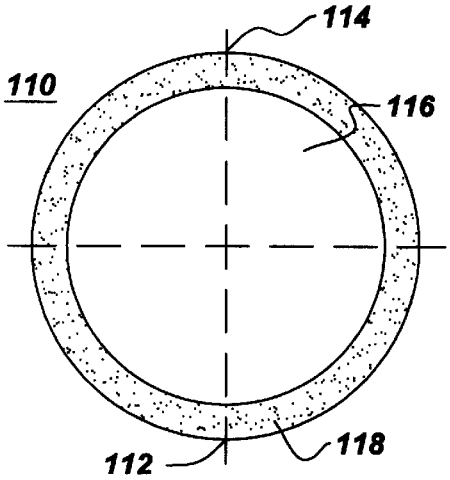
FIG. 10 is a cross-section of the electrode of FIG. 8 taken along the line 2 and of the electrode of FIG. 13 taken along the line 4.

An electrode 110 embodiment for forming the curved turbulator configuration in radial cooling passage 30 within airfoil 10 is schematically depicted in FIG. 8, and cross-sections taken at lines 1 and 2 of the electrode are shown in FIGS. 9 and 10. Electrode 110 includes a leading face 112 having a curved turbulator pattern 170, as shown for example in FIG. 8. Electrode 110 also includes a trailing face 114 having a complementary curved turbulator pattern 178, as shown for example in FIG. 12. Electrode 110 includes a conductive core 116 and an insulating coating 118 disposed on the conductive core, as shown for example in FIG. 10. The insulating coating is partly removed, for example by laser ablation, as shown for example in FIG. 9 for a cross-section of electrode 110 taken at line 2. One exemplary laser ablation technique is described in commonly assigned, above referenced U.S. Pat. No. 6,303,193 B1.

Figure 11:
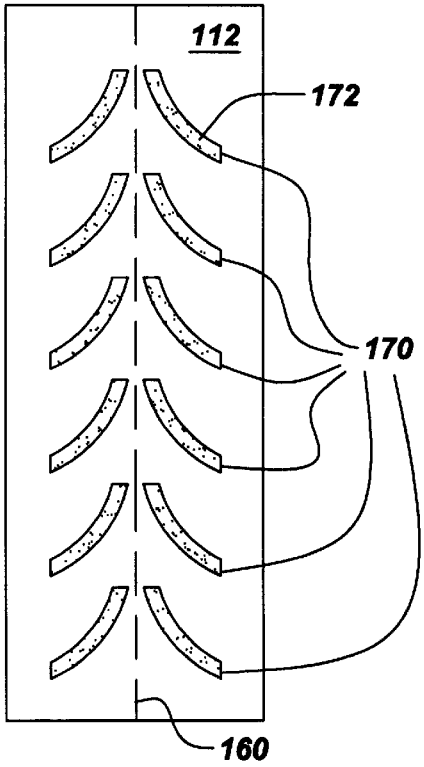
FIG. 11 shows a leading face of the electrode of FIG. 8.
Figure 12:
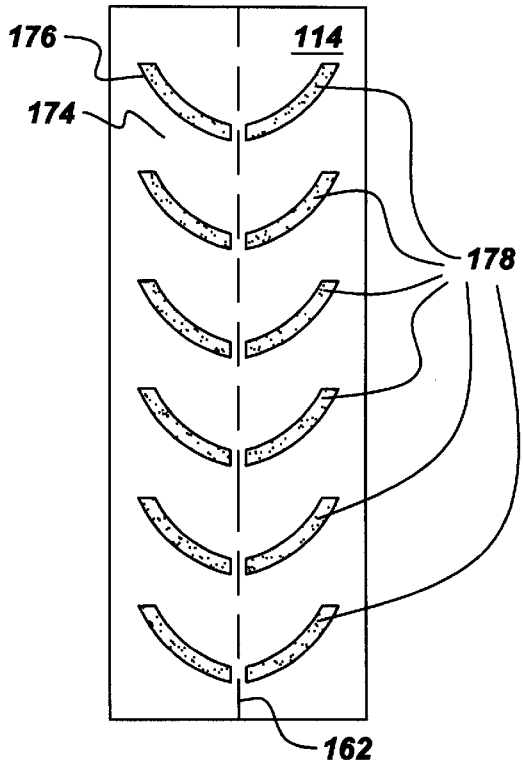
FIG. 12 shows a trailing face of the electrode of FIG. 8.

For one electrode 110 embodiment, as shown in FIGS. 11 and 12, the insulating coating 118 is partly removed, for example by laser ablation, to provide a number of pairs of curved portions 172 of insulating coating 118 on leading face 112 and a number of pairs of complementary curved portions 176 of insulating coating 118 on trailing face 114. As illustrated in FIGS. 8 and 12, each pair of curved portions 172 and pair of complementary curved portions 176 is surrounded by an exposed region 174 of the conductive core 116. Thus, for the electrode of this embodiment the curved turbulator pattern 170 includes pairs of curved portions 172 of insulating coating 118. Similarly, the complementary curved turbulator pattern 178 includes pairs of complementary curved portions 176 of insulating coating 118. Because curved and complementary curved turbulator patterns 170, 178 comprise curved and complementary curved portions 172, 176 of insulating coating 118, this electrode 110 embodiment is configured to machine curved turbulator pairs 50, 52 that comprise raised ridges. Namely, the resulting curved turbulator pairs 50, 52 will comprise raised ridges that protrude from inner surfaces 37, 39 of radial cooling passage 30.

The conductive core 116 is hollow according to one embodiment to allow for pumping of an electrolyte solution into a predrilled hole 101 through an inlet 120 and out of an exit hole 122, as shown for example in FIG. 8. Exemplary conductive cores are cylindrical in shape, having the circular cross-section shown in FIGS. 9 and 10. However, other exemplary conductive cores have rectangular or asymmetric cross sections (not shown).

An alternative, solid electrode 110 embodiment is shown in FIG. 21. The solid electrode is similar to hollow electrode 110 except that the conductive core 116 is solid and the electrolyte solution is pumped into predrilled hole 101 in the gap 102 between solid electrode 110 and predrilled hole 101, as shown for example in FIG. 21. Further, the solid electrode embodiment is typically use for through predrilled holes (also indicated by reference numeral 101), as illustrated in FIG. 21. This solid electrode embodiment is beneficial when machining long holes, where hollow electrode 110 may have excessive tool voltage drops along the length (for example greater than about ten cm, for a diameter of about 2 mm) of the hollow electrode due to high Ohmic resistance along the length of the hollow electrode 110.

In order to machine a curved turbulator configuration that enhances the flow of coolant within radial cooling passage 30, according to another embodiment, the curved portions 172 of insulating coating 118 are curved facing away from center-line 160 of leading face 112 and towards a tip 130 of the electrode 110, as shown for example in FIGS. 8 and 11. Similarly, the complementary curved portions 176 of insulating coating 118 are curved facing center-line 162 of trailing face 114 and towards tip 130 of electrode 110, as shown for example in FIG. 12.

Another electrode (also indicated by reference numeral 110) embodiment for forming the curved turbulator configuration in radial cooling passage 30 within airfoil 10 is depicted in FIG. 13, and cross-sections taken at lines 4 and 3 of the electrode are shown in FIGS. 10 and 14. The electrode of this embodiment is similar to the electrodes shown in FIGS. 8 and 21, and descriptions of similar features will not be repeated. The electrode of this embodiment also includes insulating coating 118 disposed on conductive core 116, as shown for example in FIG. 10. Electrode 110 (and correspondingly conductive core 116) can be hollow as in FIG. 8 or solid as in FIG. 21. Insulating coating 118 is partly removed, for example by laser ablation, as shown for example in FIG. 14 to expose portions of conductive core 116. However, for this embodiment a curved turbulator pattern 150 includes a number of pairs of curved exposed portions 154 of conductive core 116, as shown for example in FIG. 15. Curved exposed portions 154 are formed on leading face 112. Similarly, a complementary curved turbulator pattern 152 includes a number of pairs of complementary curved exposed portions 156 of conductive core 116 as shown for example in FIG. 16. Complementary curved exposed portions 156 are formed on trailing face 114. Curved turbulator and complementary curved turbulator patterns 150, 152 are formed, for example, by laser ablation of insulating coating 118 to expose the curved exposed portions 154 and the complementary curved exposed portions 156 of conductive core 116. Because curved and complementary curved turbulator patterns 150, 152 comprise curved and complementary curved exposed portions 154, 156 of conductive core 116, this electrode 110 embodiment is configured to machine curved turbulator pairs 50, 52 that comprise grooves. Namely, the resulting curved turbulator pairs 50, 52 will comprise grooves formed within leading and trailing walls 36, 38 of radial cooling passage 30.

Figure 15:
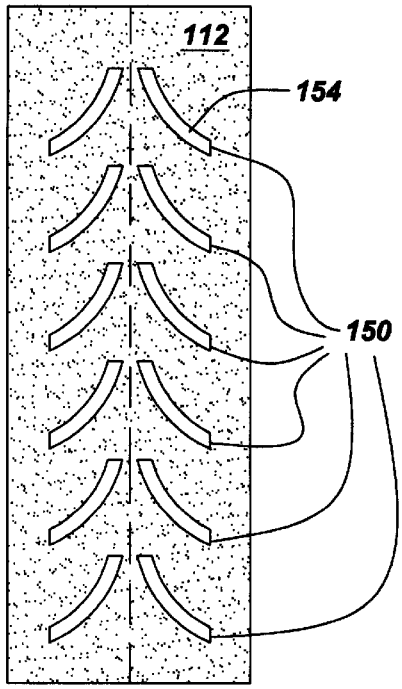
FIG. 15 shows a leading face of the electrode of FIG. 13.
Figure 16:
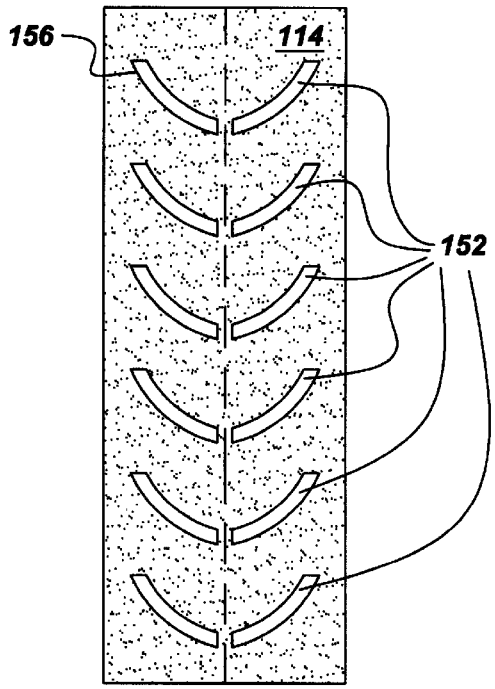
FIG. 16 shows a trailing face of the electrode of FIG. 13.

To machine a curved turbulator configuration that enhances the flow of coolant within radial cooling passage 30, according to a more specific embodiment, curved exposed portions 154 of conductive core 116 are curved facing away from center-line 160 of leading face 112 and towards the tip 130 of electrode 110, as shown for example in FIGS. 13 and 15. Similarly, complementary curved exposed portions 156 of conductive core 116 are curved facing center-line 162 of trailing face 114 and towards the tip of the electrode, as shown for example in FIG. 16.

A method embodiment of forming the curved turbulator configuration incorporates electrode 110 to perform electrochemical machining. The electrochemical machining method includes positioning electrode 110 in predrilled hole 101 in airfoil 10, as shown for example in FIGS. 8 and 13. Next, at least one pair 50 of curved turbulators on inner surface 37 of leading wall 36 are machined using curved turbulator pattern 170, and at least one pair 52 of complementary curved turbulators on inner surface 39 of trailing wall 38 are machined using complementary curved turbulator pattern 178. The pairs of curved turbulators and complementary curved turbulators are machined simultaneously by passing an electric current between the electrode and the airfoil while circulating an electrolyte solution through the predrilled hole. The electrolyte is pumped into an end 124 of predrilled hole 101 under pressure. As illustrated in FIG. 8, where electrode 110 is hollow, the electrolyte enters electrode 110 through inlet 120 and exits through exit hole 122. Alternatively, for solid electrode 110, the electrolyte is flowed into the gap 102 between electrode 110 and the through predrilled hole 101, as shown for example in FIG. 21.

The (+) and (−) designations in FIGS. 8 and 13 indicate pulsed voltage through the electrode and airfoil. The current is provided by coupling electrode 110 to a negative terminal of a STEM power supply (not shown) and airfoil 10 to a positive terminal thereof.

In this manner, curved and complementary curved turbulators 50, 52 that protrude from leading and trailing walls 36, 38, respectively, are formed. Essentially, material is removed from predrilled hole 101 upon application of the electric current in regions of predrilled hole 101 coinciding with exposed region 174 of conductive core 116 in electrode 110. However, the remaining insulating coating 116 at curved and complementary curved turbulator patterns 170, 178 shields corresponding regions of the predrilled hole during application of the electric current, thereby preserving turbulators 50, 52, which accordingly protrude from leading and trailing walls 36, 38, respectively.

Alternatively, the curved turbulators 50 are machined on inner surface 37 of leading wall 36 using curved turbulator pattern 150, and the complementary curved turbulators 52 are machined on inner surface 39 of trailing wall 38 using complementary curved turbulator pattern 178. As with the previously described method, the curved and complementary curved turbulators are machined simultaneously by passing an electric current between the electrode and the airfoil while circulating an electrolyte solution through the predrilled hole. According to this embodiment, the curved and complementary curved turbulators 50, 52 comprise grooves or cavities on inner surfaces 37, 39 of leading and trailing walls 36, 38, respectively. Essentially, material is removed from predrilled hole 101 upon application of the electric current in regions of predrilled hole 101 coinciding with curved exposed portions 154, 156 of conductive core 116 in electrode 110. As the remaining insulating coating 118 shields the remainder of the predrilled hole, turbulators 50, 52 are formed as grooves or cavities in leading and trailing walls 36, 38, respectively.

According to one embodiment of the electrochemical machining method, a number of curved turbulators pairs 50 spaced along centerline 48 and a number of complementary curved turbulator pairs 52 spaced along center-line 54 are simultaneously machined by passing the electric current between electrode 110 and airfoil 10 while circulating the electrolyte solution through predrilled hole 101.

According to a more particular embodiment, the electrochemical machining method, employs the electrode discussed above with respect to FIG. 8. Alternatively, the electrochemical machining method employs the alternative electrode embodiment discussed above with respect to FIG. 13.

Where the electrochemical machining method uses the electrode 110 discussed above with respect to FIG. 8, in order to machine the curved turbulator configuration that enhances the flow of coolant discussed above with respect to the airfoil embodiment, curved portions 172 of insulating coating 118 are curved facing away from center-line 160 and towards the tip 130 of electrode 110, as shown for example in FIG. 11. Similarly, complementary curved portions 176 of insulating coating 118 are curved facing center-line 162 and towards tip 130, as shown for example in FIG. 12.

Where the electrochemical machining method uses the electrode 110 embodiment discussed above with respect to FIG. 13, in order to machine the curved turbulator configuration that enhances the flow of coolant discussed above with respect to the airfoil embodiment, curved exposed portions 154 of conductive core 116 are curved facing away from center-line 160 and towards the tip 130 of the electrode, as shown for example in FIG. 15. Similarly, complementary curved exposed portions 156 of conductive core 116 are curved facing center-line 162 and towards tip 130, as shown for example in FIG. 16.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A curved turbulator configuration in a radial cooling passage of an airfoil, the radial cooling passage defined by at least a leading wall and a trailing wall, the airfoil including a tip and a root, said curved turbulator configuration comprising:

a plurality of spaced curved turbulator pairs positioned along a center-line on an inner surface of the leading wall, wherein said curved turbulator pairs are curved facing away from the center-line of the leading wall and facing the top of the airfoil; and a plurality of spaced complementary curved turbulator pairs positioned along a center-line on an inner surface of the trailing wall, wherein said complementary curved turbulator pairs are curved facing the center line of the trailing wall and facing the tip of the airfoil.

2. The curved turbulator configuration of claim 1, wherein each curved turbulator pair comprises two curved turbulators separated by a first gap, and wherein each complementary curved turbulator pair comprises two complementary curved turbulators separated by a second gap.

3. The curved turbulator configuration of claim 2, wherein said curved turbulators and said complementary curved turbulators comprise grooves formed in said inner surfaces of said leading and trailing walls, respectively.

4. The curved turbulator configuration of claim 2, wherein said curved turbulators and said complementary curved turbulators protrude from said inner surfaces of said leading and trailing walls, respectively.

5. The curved turbulator configuration of claim 2, wherein said curved turbulators have a first depth and a first width, wherein said complementary curved turbulators have a second depth and a second width, and wherein the depths and the widths are in a range of about 0.13 mm to about 2.54 mm.

6. The curved turbulator configuration of claim 5, wherein the gaps are in a range of about 0.13 mm to about 2.54 mm.

7. The curved turbulator configuration of claim 6, wherein said curved turbulator pairs are separated by a first pitch distance and said complementary curved turbulator pairs are separated by a second pitch distance, the pitch distances being in a range of about 0.64 mm to about 50.8 mm.

8. The curved turbulator configuration of claim 7, wherein the pitch distances are in a range of about 0.89 mm to about 38.1 mm.

9. The curved turbulator configuration of claim 5, wherein the depths and the widths are in a range of about 0.25 mm to about 1.27 mm.

10. The curved turbulator configuration of claim 9, wherein the gaps are in a range of about 0.25 mm to about 1.27 mm.

11. The curved turbulator configuration of claim 10, wherein said curved turbulator pairs are separated by a first pitch distance and said complementary curved turbulator pairs are separated by a second pitch distance, the pitch distances being in a range of about 1.27 mm to about 25.4 mm.

12. The curved turbulator configuration of claim 11, wherein the pitch distances are in a range of about 1.78 mm to about 19.1 mm.

13. An airfoil comprising:

a tip including at least one exit hole;

a root;

a body extending between said tip and said root, said body including a pressure side and a suction side and a leading wall on said suction side and a trailing wall on said pressure side;

at least one radial cooling passage extending through said body between said tip and said root, said radial cooling passage being defined by at least an inner surface of said leading wall and an inner surface of said trailing wall;

a curved turbulator configuration integrated with the inner surfaces of said leading and trailing walls, said curved turbulator configuration comprising:

a plurality of spaced curved turbulator pairs positioned along a center-line on the inner surface of said leading wall, wherein said curved turbulator pairs are curved facing away from the center-line of said leading wall and facing said tip; and a plurality of spaced complementary curved turbulator pairs positioned along a center-line on the inner surface of said trailing wall, wherein said complementary curved turbulator pairs are curved facing the center line of said trailing wall and facing said tip, wherein said exit hole is connected to said radial cooling passage and is configured to vent coolant from said airfoil after the coolant flows through said radial cooling passage.

14. A rotor blade comprising:

a shank;

an airfoil attached to said shank, said airfoil comprising:

a tip including at least one exit hole;

a root;

a body extending between said tip and said root, said body including a pressure side and a suction side and a leading wall on said suction side and a trailing wall on said pressure side;

at least one radial cooling passage extending through said body between said tip and said root, said radial cooling passage being defined by at least an inner surface of said leading wall and an inner surface of said trailing wall;

a curved turbulator configuration integrated with the inner surfaces of said leading and trailing walls, said curved turbulator configuration comprising:

a plurality of spaced curved turbulator pairs positioned along a center-line on the inner surface of said leading wall, wherein said curved turbulator pairs are curved facing away from the center-line of said leading wall and facing said tip; and a plurality of spaced complementary curved turbulator pairs positioned along a center-line on the inner surface of said trailing wall, wherein said complementary curved turbulator pairs are curved facing the center line of said trailing wall and facing said tip, wherein said exit hole is connected to said radial cooling passage and is configured to vent coolant from the airfoil after the coolant flows through said cooling passage.

15. The rotor blade of claim 14, wherein said shank comprises:

a blade platform;

a dovetail; and at least one inlet configured for passage of coolant to said radial cooling passage, wherein said shank is attached to said airfoil at said blade platform, and wherein said blade platform is positioned between said dovetail and said airfoil.

16. An electrochemical machining method for forming a curved turbulator configuration on an inner surface of a leading wall of an airfoil and on an inner surface of a trailing wall of the airfoil, the inner surfaces defining a radial cooling passage extending between a tip and a root of the airfoil, said electrochemical machining method comprising:

positioning an electrode in a predrilled hole in the airfoil, the electrode comprising a conductive core and an insulating coating, the electrode having a leading face and a trailing face, wherein the insulating coating provides a curved turbulator pattern on the leading face and a complementary curved turbulator pattern on the trailing face;

machining at least one pair of curved turbulators on the inner surface of the leading wall using the curved turbulator pattern and at least one pair of complementary curved turbulators on the inner surface of the trailing wall using the complementary curved turbulator pattern, the pairs of curved turbulators and complementary curved turbulators being machined simultaneously by passing an electric current between the electrode and the airfoil while circulating an electrolyte solution through the predrilled hole, wherein a plurality of curved turbulators pairs spaced along a center-line of the inner surface of the leading wall are simultaneously machined with a plurality of complementary curved turbulator pairs spaced along a center-line of the inner surface of the trailing wall, said simultaneous machining comprising passing the electric current between the electrode and the airfoil while circulating the electrolyte solution through the predrilled hole, wherein the curved turbulator pairs are curved facing away from the center-line of the leading wall and facing the tip of the airfoil, wherein the complementary curved turbulator pairs are curved facing the center line of the trailing wall and facing the tip of the airfoil.

17. The electrochemical machining method of claim 16, wherein the insulating coating is partially removed, the curved turbulator pattern comprising a plurality of pairs of curved exposed portions of the conductive core for forming the curved turbulator pairs, and the complementary curved turbulator pattern comprising a plurality of pairs of complementary curved exposed portions of the conductive core for forming the complementary curved turbulator pairs.

18. The electrochemical machining method of claim 17, wherein the curved exposed portions of the conductive core are curved facing away from a center-line of the leading face of the electrode and towards a tip of the electrode, and wherein the complementary curved exposed portions of the conductive core are curved facing a center-line of the trailing face of the electrode and towards the tip of the electrode.

19. The electrochemical machining method of claim 16; wherein the insulating coating is partially removed to include a plurality of pairs of curved portions of the insulating coating on the leading face and a plurality of pairs of complementary curved portions of the insulating coating on the trailing face, each of the pairs of curved portions and the pairs of complementary curved portions being surrounded by an exposed section of the conductive core, wherein the curved turbulator pattern comprises the pairs of curved portions and the complementary turbulator pattern comprises the pairs of complementary curved portions.

20. The electrochemical machining method of claim 19, wherein the curved portions of the insulating coating are curved facing away from a center-line of the leading face of the electrode and towards a tip of the electrode, and wherein the complementary curved portions of the insulating coating are curved facing a center-line of the trailing face of the electrode and towards the tip of the electrode.

21. An electrode for forming a curved turbulator configuration in a radial cooling passage within an airfoil, said electrode comprising:

a tip, a leading face having a curved turbulator pattern;

a trailing face having a complementary curved turbulator pattern;

a conductive core; and an insulating coating disposed on said conductive core, said insulating coating being partly removed, wherein said curved turbulator pattern comprises a plurality of pairs of curved exposed portions of the conductive core wherein said curved exposed portions of said conductive core are curved facing away from a center-line of said leading face of said electrode and towards said tip, and said complementary curved turbulator pattern comprises a plurality of pairs of complementary curved exposed portions of the conductive core, wherein said complementary curved exposed portions of said conductive core are curved facing a center-line of said trailing face of the electrode and towards said tip.

22. An electrode for forming a curved turbulator configuration in a radial cooling passage within an airfoil, said electrode comprising:

a tip, a leading face having a curved turbulator pattern;

a trailing face having a complementary curved turbulator pattern;

a conductive core; and an insulating coating disposed on said conductive core, said insulating coating being partly removed to include a plurality of pairs of curved portions of said insulating coating on said leading face and a plurality of pairs of complementary curved portions of said insulating coating on said trailing face, each of said curved portions and said complementary curved portions being surrounded by an exposed region of said conductive core, wherein said curved turbulator pattern comprises said pairs of curved portions of said insulating coating wherein said curved portions of said insulating coating are curved facing away from a center-line of said leading face of said electrode and towards said tip, and said complementary curved turbulator pattern comprises said pairs of complementary curved portions of said insulating coating, wherein said complementary curved portions of said insulating coating are curved facing a center-line of said trailing face of said electrode and towards said tip.

* * * * *